US009137611B2

(12) United States Patent
Unno et al.

(10) Patent No.: US 9,137,611 B2
(45) Date of Patent: Sep. 15, 2015

(54) METHOD, SYSTEM AND COMPUTER PROGRAM PRODUCT FOR ESTIMATING A LEVEL OF NOISE

(75) Inventors: Takahiro Unno, Richardson, TX (US); Nitish Krishna Murthy, Allen, TX (US)

(73) Assignee: TEXAS INSTRUMENTS INCORPORATION, Dallas, TX (US)

( * ) Notice: Subject to any disclaimer, the term of this patent is extended or adjusted under 35 U.S.C. 154(b) by 583 days.

(21) Appl. No.: 13/594,401

(22) Filed: Aug. 24, 2012

(65) Prior Publication Data

US 2013/0051570 A1 Feb. 28, 2013

Related U.S. Application Data

(63) Continuation-in-part of application No. 13/589,237, filed on Aug. 20, 2012.

(60) Provisional application No. 61/526,948, filed on Aug. 24, 2011.

(51) Int. Cl.

| | |
|---|---|
| ***G10L 21/02*** | (2013.01) |
| ***H04R 25/00*** | (2006.01) |
| ***H04R 3/00*** | (2006.01) |

(52) U.S. Cl.

CPC ..... *H04R 25/405* (2013.01); *H04R 3/005* (2013.01); *H04R 2430/03* (2013.01); *H04R 2499/11* (2013.01)

(58) Field of Classification Search

USPC ..... 704/226, 233; 455/51.1, 501

See application file for complete search history.

(56) References Cited

U.S. PATENT DOCUMENTS

| | | | | |
|---|---|---|---|---|
| 4,696,040 | A * | 9/1987 | Doddington et al. | 704/234 |
| 6,249,757 | B1 * | 6/2001 | Cason | 704/214 |
| 6,993,480 | B1 * | 1/2006 | Klayman | 704/226 |
| 2006/0262938 | A1 * | 11/2006 | Gauger et al. | 381/56 |
| 2011/0123019 | A1 | 5/2011 | Gowreesunker et al. | |

OTHER PUBLICATIONS

Ephraim et al., "Speech Enhancement Using a Minimum Mean-Square Error Short-Time Spectral Amplitude Estimator", IEEE Transactions on Acoustics, Speech, and Signal Processing, Dec. 1984, pp. 1109-1121, vol. ASSP-32, No. 6, IEEE.

(Continued)

*Primary Examiner* — Abul Azad

(74) *Attorney, Agent, or Firm* — Michael A. Davis, Jr.; Frank D. Cimino

(57) ABSTRACT

In response to a signal failing to exceed an estimated level of noise by more than a predetermined amount for more than a predetermined continuous duration, the estimated level of noise is adjusted according to a first time constant in response to the signal rising and a second time constant in response to the signal falling, so that the estimated level of noise falls more quickly than it rises. In response to the signal exceeding the estimated level of noise by more than the predetermined amount for more than the predetermined continuous duration, a speed of adjusting the estimated level of noise is accelerated.

27 Claims, 4 Drawing Sheets

(56) References Cited

OTHER PUBLICATIONS

Parikh et al., "Perceptual Artifacts in Speech Noise Suppression", IEEE, 2010, pp. 99-103, Asilomar, Georgia Institute of Technology, Atlanta, GA, U.S.A.
Parikh et al., "Gain Adaptation Based on Signal-To-Noise Ratio for Noise Suppression", IEEE Workshop on Applications of Signal Processing to Audio and Acoustics, Oct. 18-21, 2009, pp. 185-188, IEEE, New Paltz, NY.
Takahashi et al., "Blind Spatial Subtraction Array for Speech Enhancement in Noisy Environment", IEEE Transactions on Audio, Speech, and Language Processing, May 2009, pp. 650-664, vol. 17 No. 4, IEEE.
Parikh et al., "Blind Source Separation with Perceptual Post Processing", IEEE DSP/SPE, 2011, pp. 321-325, Georgia Institute of Technology, Atlanta, GA, U.S.A.
Anderson, David V., "A Modulation View of Audio Processing for Reducing Audible Artifacts", IEEE ICASSP, 2010, pp. 5474-5477, Georgia Institute of Technology, Atlanta, GA, U.S.A.
Cappe, Olivier, "Elimination of the Musical Noise Phenomenon with the Ephraim and Malah Noise Suppressor", IEEE Transactions on Speech and Audio Processing, Apr. 1994, pp. 345-349, vol. 2, No. 2, IEEE.

* cited by examiner

METHOD, SYSTEM AND COMPUTER PROGRAM PRODUCT FOR ESTIMATING A LEVEL OF NOISE

CROSS-REFERENCE TO RELATED APPLICATIONS

This application claims priority to U.S. Provisional Patent Application Ser. No. 61/526,948, filed Aug. 24, 2011, entitled ROBUST NOISE FLOOR LEVEL ESTIMATION FOR INSTANT NOISE ENVIRONMENT CHANGE, naming Takahiro Unno et al. as inventors.

This application claims priority to and is a continuation-in-part of co-owned co-pending U.S. patent application Ser. No. 13/589,237, filed Aug. 20, 2012, entitled METHOD, SYSTEM AND COMPUTER PROGRAM PRODUCT FOR ATTENUATING NOISE IN MULTIPLE TIME FRAMES, naming Takahiro Unno as inventor, which claims priority to U.S. Provisional Patent Application Ser. No. 61/526,962, filed Aug. 24, 2011, entitled JOINT A PRIORI SNR AND POSTERIOR SNR ESTIMATION FOR BETTER SNR ESTIMATION AND SNR-ATTENUATION MAPPING IN NON-LINEAR PROCESSING NOISE SUPPRESSOR, naming Takahiro Unno as inventor.

All of the above-identified applications are hereby fully incorporated herein by reference for all purposes.

BACKGROUND

The disclosures herein relate in general to audio processing, and in particular to a method, system and computer program product for estimating a level of noise.

In audio processing systems, a level of a signal's noise may be estimated for various purposes, such as noise suppression, voice activity detection, noise adaptive volume control, and echo suppression. For estimating the level of the signal's noise, a time constant may be applied. If the time constant is too slow, then such estimate is less accurate if it slowly adapts to a sudden change in the signal from a relatively quiet environment (e.g., enclosed office) to a relatively noisy environment (e.g., urban street). Conversely, if the time constant is not slow enough, then such estimate is less accurate if it mistakenly increases in response to a sudden rise in the signal.

SUMMARY

In response to a signal failing to exceed an estimated level of noise by more than a predetermined amount for more than a predetermined continuous duration, the estimated level of noise is adjusted according to a first time constant in response to the signal rising and a second time constant in response to the signal falling, so that the estimated level of noise falls more quickly than it rises. In response to the signal exceeding the estimated level of noise by more than the predetermined amount for more than the predetermined continuous duration, a speed of adjusting the estimated level of noise is accelerated.

DETAILED DESCRIPTION

Figure 1:
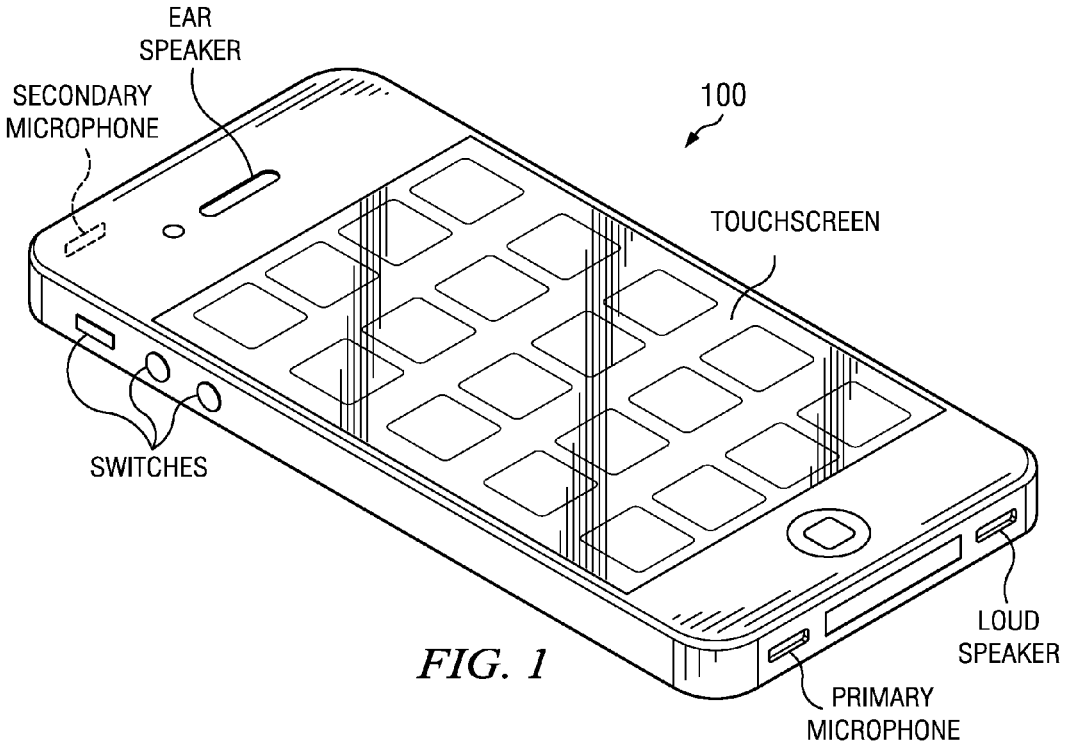
FIG. 1 is a perspective view of a mobile smartphone that includes an information handling system of the illustrative embodiments.

FIG. 1 is a perspective view of a mobile smartphone, indicated generally at 100, that includes an information handling system of the illustrative embodiments. In this example, the smartphone 100 includes a primary microphone, a secondary microphone, an ear speaker, and a loud speaker, as shown in FIG. 1. Also, the smartphone 100 includes a touchscreen and various switches for manually controlling an operation of the smartphone 100.

Figure 2:
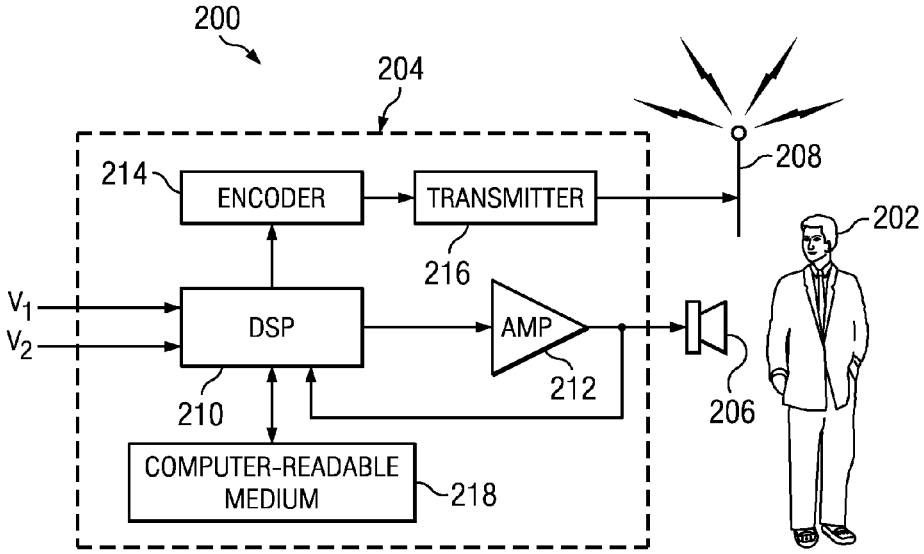
FIG. 2 is a block diagram of the information handling system of the illustrative embodiments.

FIG. 2 is a block diagram of the information handling system, indicated generally at 200, of the illustrative embodiments. A human user 202 speaks into the primary microphone (FIG. 1), which converts sound waves of the speech (from the user 202) into a primary voltage signal $V_1$. The secondary microphone (FIG. 1) converts sound waves of noise (e.g., from an ambient environment that surrounds the smartphone 100) into a secondary voltage signal $V_2$. Also, the signal $V_1$ contains the noise, and the signal $V_2$ contains leakage of the speech.

A control device 204 receives the signal $V_1$ (which represents the speech and the noise) from the primary microphone and the signal $V_2$ (which represents the noise and leakage of the speech) from the secondary microphone. In response to the signals $V_1$ and $V_2$, the control device 204 outputs: (a) a first electrical signal to a speaker 206; and (b) a second electrical signal to an antenna 208. The first electrical signal and the second electrical signal communicate speech from the signals $V_1$ and $V_2$, while suppressing at least some noise from the signals $V_1$ and $V_2$.

In response to the first electrical signal, the speaker 206 outputs sound waves, at least some of which are audible to the human user 202. In response to the second electrical signal, the antenna 208 outputs a wireless telecommunication signal (e.g., through a cellular telephone network to other smartphones). In the illustrative embodiments, the control device 204, the speaker 206 and the antenna 208 are components of the smartphone 100, whose various components are housed integrally with one another. Accordingly in a first example, the speaker 206 is the ear speaker of the smartphone 100. In a second example, the speaker 206 is the loud speaker of the smartphone 100.

The control device 204 includes various electronic circuitry components for performing the control device 204 operations, such as: (a) a digital signal processor ("DSP") 210, which is a computational resource for executing and otherwise processing instructions, and for performing additional operations (e.g., communicating information) in response thereto; (b) an amplifier ("AMP") 212 for outputting the first electrical signal to the speaker 206 in response to information from the DSP 210; (c) an encoder 214 for outputting an encoded bit stream in response to information from the DSP 210; (d) a transmitter 216 for outputting the second electrical signal to the antenna 208 in response to the encoded bit stream; (e) a computer-readable medium 218 (e.g., a non-volatile memory device) for storing information; and (f) various other electronic circuitry (not shown in FIG. 2) for performing other operations of the control device 204.

The DSP 210 receives instructions of computer-readable software programs that are stored on the computer-readable medium 218. In response to such instructions, the DSP 210 executes such programs and performs its operations, so that the first electrical signal and the second electrical signal communicate speech from the signals $V_1$ and $V_2$, while suppressing at least some noise from the signals $V_1$ and $V_2$. For executing such programs, the DSP 210 processes data, which are stored in memory of the DSP 210 and/or in the computer-readable medium 218. Optionally, the DSP 210 also receives the first electrical signal from the amplifier 212, so that the DSP 210 controls the first electrical signal in a feedback loop.

In an alternative embodiment, the primary microphone (FIG. 1), the secondary microphone (FIG. 1), the control device 204 and the speaker 206 are components of a hearing aid for insertion within an ear canal of the user 202. In one version of such alternative embodiment, the hearing aid omits the antenna 208, the encoder 214 and the transmitter 216.

Figure 3:
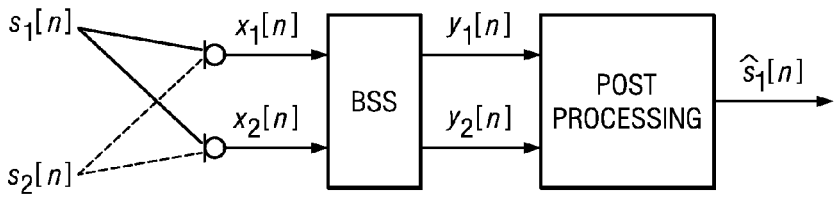
FIG. 3 is an information flow diagram of an operation of the system of FIG. 2.

FIG. 3 is an information flow diagram of an operation of the system 200. In accordance with FIG. 3, the DSP 210 performs an adaptive linear filter operation to separate the speech from the noise. In FIG. 3, $s_1[n]$ and $s_2[n]$ represent the speech (from the user 202) and the noise (e.g., from an ambient environment that surrounds the smartphone 100), respectively, during a time frame n. Further, $x_1[n]$ and $x_2[n]$ are digitized versions of the signals $V_1$ and $V_2$, respectively, of FIG. 2.

Accordingly: (a) $x_1[n]$ contains information that primarily represents the speech, but also the noise; and (b) $x_2[n]$ contains information that primarily represents the noise, but also leakage of the speech. The noise includes directional noise (e.g., a different person's background speech) and diffused noise. The DSP 210 performs a dual-microphone blind source separation ("BSS") operation, which generates $y_1[n]$ and $y_2[n]$ in response to $x_1[n]$ and $x_2[n]$, so that: (a) $y_1[n]$ is a primary channel of information that represents the speech and the diffused noise while suppressing most of the directional noise from $x_1[n]$; and (b) $y_2[n]$ is a secondary channel of information that represents the noise while suppressing most of the speech from $x_2[n]$.

After the BSS operation, the DSP 210 performs a non-linear post processing operation for suppressing noise, without estimating a phase of $y_1[n]$. In the post processing operation, the DSP 210: (a) in response to $y_2[n]$, estimates the diffused noise within $y_1[n]$; and (b) in response to such estimate, generates $\hat{s}_1[n]$, which is an output channel of information that represents the speech while suppressing most of the noise from $y_1[n]$. As discussed hereinabove in connection with FIG. 2, the DSP 210 outputs such $\hat{s}_1[n]$ information to: (a) the AMP 212, which outputs the first electrical signal to the speaker 206 in response to such $\hat{s}_1[n]$ information; and (b) the encoder 214, which outputs the encoded bit stream to the transmitter 216 in response to such $\hat{s}_1[n]$ information. Optionally, the DSP 210 writes such $\hat{s}_1[n]$ information for storage on the computer-readable medium 218.

Figure 4:
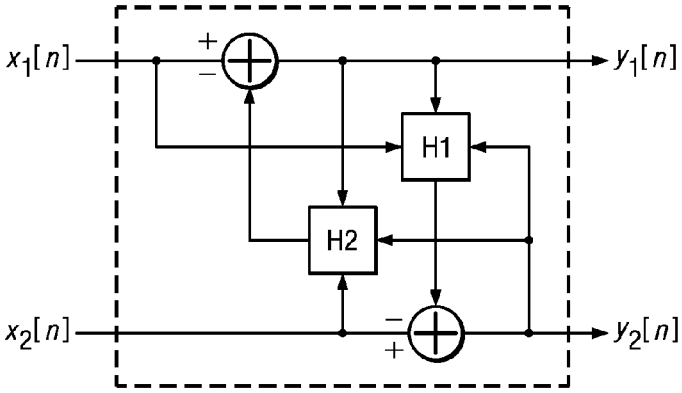
FIG. 4 is an information flow diagram of a blind source separation operation of FIG. 3.

FIG. 4 is an information flow diagram of the BSS operation of FIG. 3. A speech estimation filter H1: (a) receives $x_1[n]$, $y_1[n]$ and $y_2[n]$; and (b) in response thereto, adaptively outputs an estimate of speech that exists within $y_1[n]$. A noise estimation filter H2: (a) receives $x_2[n]$, $y_1[n]$ and $y_2[n]$; and (b) in response thereto, adaptively outputs an estimate of directional noise that exists within $y_2[n]$.

As shown in FIG. 4, $y_1[n]$ is a difference between: (a) $x_1[n]$; and (b) such estimated directional noise from the noise estimation filter H2. In that manner, the BSS operation iteratively removes such estimated directional noise from $x_1[n]$, so that $y_1[n]$ is a primary channel of information that represents the speech and the diffused noise while suppressing most of the directional noise from $x_1[n]$. Further, as shown in FIG. 4, $y_2[n]$ is a difference between: (a) $x_2[n]$; and (b) such estimated speech from the speech estimation filter H1. In that manner, the BSS operation iteratively removes such estimated speech from $x_2[n]$, so that $y_2[n]$ is a secondary channel of information that represents the noise while suppressing most of the speech from $x_2[n]$.

The filters H1 and H2 are adapted to reduce cross-correlation between $y_1[n]$ and $y_2[n]$, so that their filter lengths (e.g., 20 filter taps) are sufficient for estimating: (a) a path of the speech from the primary channel to the secondary channel; and (b) a path of the directional noise from the secondary channel to the primary channel. In the BSS operation, the DSP 210 estimates a level of a noise floor ("noise level") and a level of the speech ("speech level").

The DSP 210 computes the speech level by autoregressive ("AR") smoothing (e.g., with a time constant of 20 ms). The DSP 210 estimates the speech level as $P_s[n]=\alpha\cdot P_s[n-1]+(1-\alpha)\cdot y_1[n]^2$, where: (a) $\alpha=\exp(-1/F_s\tau)$; (b) $P_s[n]$ is a power of the speech during the time frame n; (c) $P_s[n-1]$ is a power of the speech during the immediately preceding time frame n−1; and (d) $F_s$ is a sampling rate. In one example, $\alpha=0.95$, and $\tau=0.02$.

The DSP 210 estimates the noise level (e.g., once per 10 ms) as: (a) if $P_s[n]>P_N[n-1]\cdot C_u$, then $P_N[n]=P_N[n-1]\cdot C_u$, where $P_N[n]$ is a power of the noise level during the time frame n, $P_N[n-1]$ is a power of the noise level during the immediately preceding time frame n−1, and $C_u$ is an upward time constant; or (b) if $P_s[n]\leq P_N[n-1]\cdot C_d$, then $P_N[n]=P_N[n-1]\cdot C_d$, where $C_d$ is a downward time constant; or (c) if neither (a) nor (b) is true, then $P_N[n]=P_s[n]$. In one example, $C_u$ is 3 dB/sec, and $C_d$ is −24 dB/sec.

Figure 5:
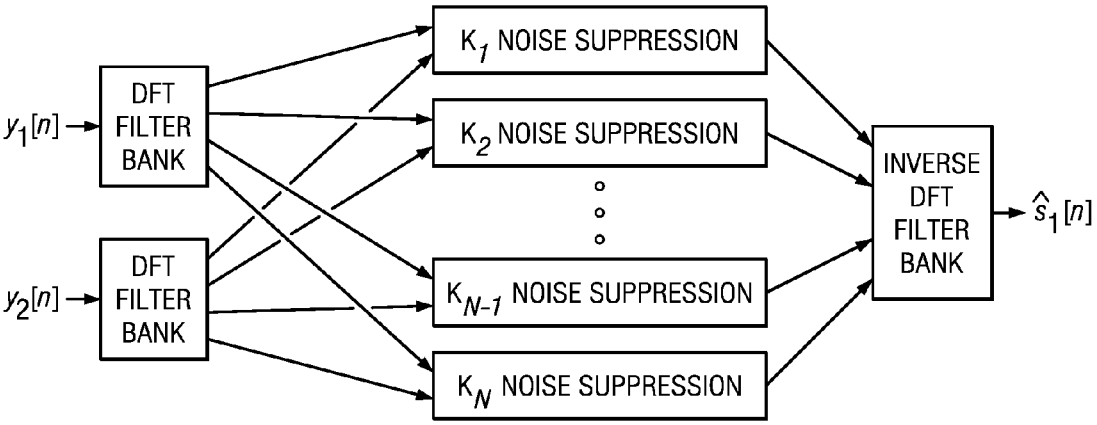
FIG. 5 is an information flow diagram of a post processing operation of FIG. 3.
Figure 6:
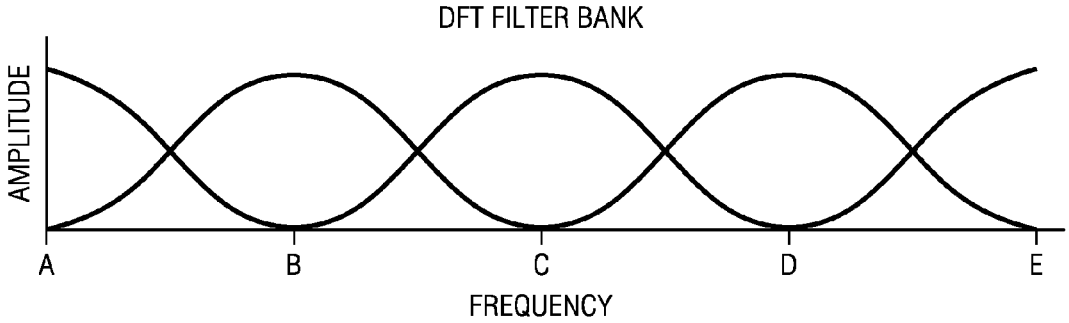
FIG. 6 is a graph of various frequency bands that are applied by a discrete Fourier transform ("DFT") filter bank operation of FIG. 5.

FIG. 5 is an information flow diagram of the post processing operation. FIG. 6 is a graph of various frequency bands that are applied by a discrete Fourier transform ("DFT") filter bank operation of FIG. 5. As shown in FIG. 6, each frequency band partially overlaps its neighboring frequency bands by fifty percent (50%) apiece. For example, in FIG. 6, one frequency band ranges from B Hz to D Hz, and such frequency band partially overlaps: (a) a frequency band that ranges from A Hz to C Hz; and (b) a frequency band that ranges from C Hz to E Hz.

A particular band is referenced as the kth band, where: (a) k is an integer that ranges from 1 through N; and (b) N is a total number of such bands. In the illustrative embodiment, N=64. Referring again to FIG. 5, in the DFT filter bank operation, the DSP 210: (a) receives $y_1[n]$ and $y_2[n]$ from the BSS operation; (b) converts $y_1[n]$ from a time domain to a frequency domain, and decomposes the frequency domain version of $y_1[n]$ into a primary channel of the N bands, which are $y_1[n, 1]$ through $y_1[n, N]$; and (c) converts $y_2[n]$ from time domain to frequency domain, and decomposes the frequency domain version of $y_2[n]$ into a secondary channel of the N bands, which are $y_2[n, 1]$ through $y_2[n, N]$.

As shown in FIG. 5, for each of the N bands, the DSP 210 performs a noise suppression operation, such as a spectral subtraction operation, minimum mean-square error ("MMSE") operation, or maximum likelihood ("ML") operation. For the kth band, such operation is denoted as the $K_k$ noise suppression operation. Accordingly, in the $K_k$ noise suppression operation, the DSP 210: (a) in response to the secondary channel's kth band $y_2[n, k]$, estimates the diffused noise within the primary channel's kth band $y_1[n, k]$; (b) in response to such estimate, computes the kth band's respective noise suppression gain G[n, k] for the time frame n; and (c) generates a respective noise-suppressed version $\hat{s}_1[n, k]$ of the primary channel's kth band $y_1[n, k]$ by applying G[n, k] thereto (e.g., by multiplying G[n, k] and the primary channel's kth band $y_1[n, k]$ for the time frame n). After the DSP 210 generates the respective noise-suppressed versions $\hat{s}_1[n, k]$ of all N bands of the primary channel for the time frame n, the DSP 210 composes $\hat{s}_1[n]$ for the time frame n by performing an inverse of the DFT filter bank operation, in order to convert a sum of those noise-suppressed versions $\hat{s}_1[n, k]$ from a frequency domain to a time domain. In real-time causal implementations of the system 200, a band's G[n, k] is variable per time frame n.

Figure 7:
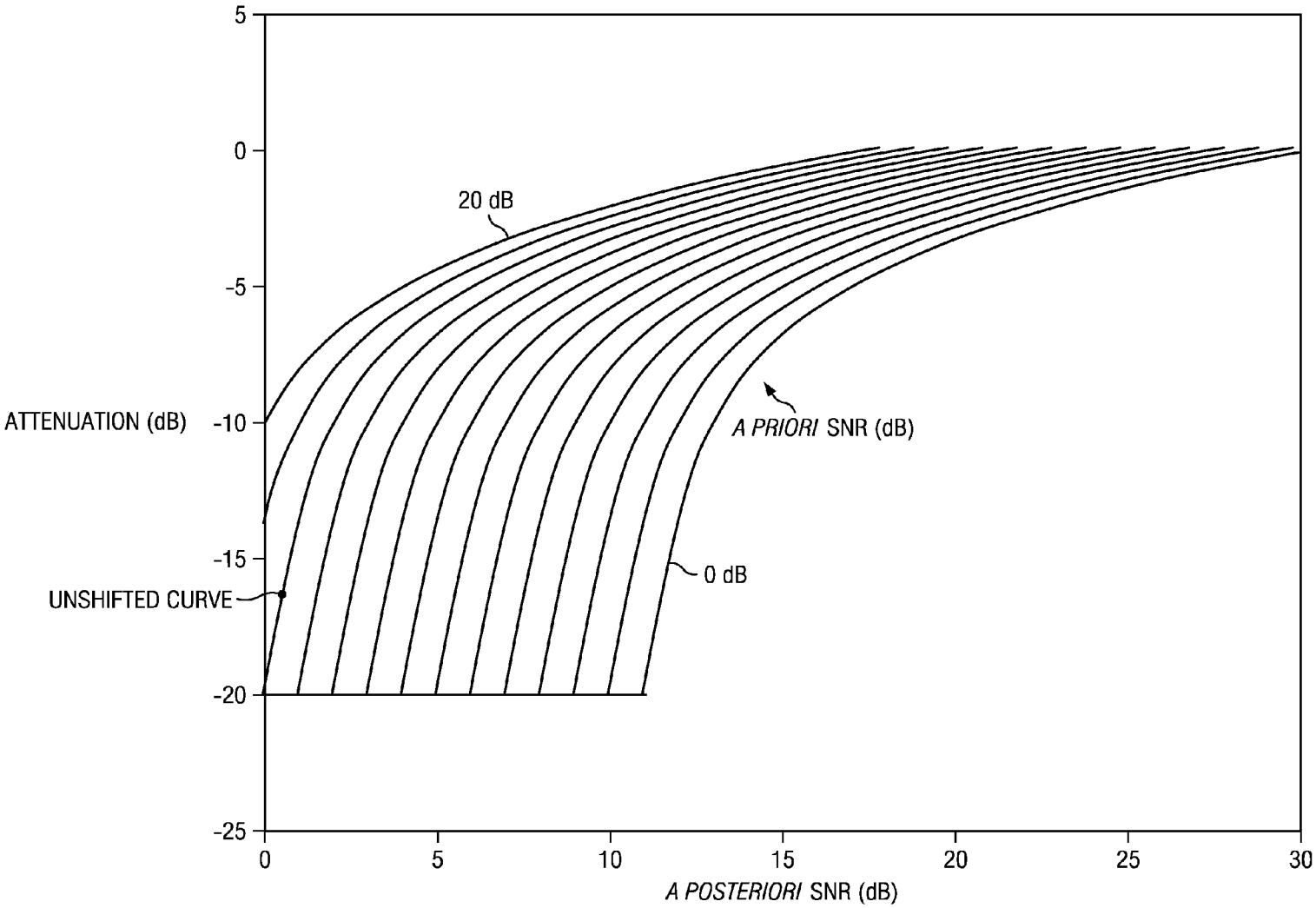
FIG. 7 is a graph of noise suppression gain in response to a signal's a posteriori speech-to-noise ratio ("SNR") and estimated a priori SNR, in accordance with one example of the illustrative embodiments.

FIG. 7 is a graph of noise suppression gain G[n, k] in response to a signal's a posteriori SNR and estimated a priori SNR, in accordance with one example of the illustrative embodiments. Accordingly, in the illustrative embodiments, the DSP 210 computes the kth band's respective noise suppression gain G[n, k] in response to both: (a) a posteriori SNR, which is a logarithmic ratio between a noisy version of the signal's energy (e.g., speech and diffused noise as represented by $y_1[n, k]$) and the noise's energy (e.g., as represented by $y_2[n, k]$); and (b) estimated a priori SNR, which is a logarithmic ratio between a clean version of the signal's energy (e.g., as estimated by the DSP 210) and the noise's energy (e.g., as represented by $y_2[n, k]$). During the time frame n, the kth band's then-current a priori SNR is not yet determined exactly, so the DSP 210 updates its decision-directed estimate of the kth band's then-current a priori SNR in response to G[n−1, k] and $y_1$ [n−1, k] for the immediately preceding time frame n−1.

For the time frame n, the DSP 210 computes:

$$P_{y_1}[n,k]=\alpha\cdot P_{y_1}[n,k]+(1-\alpha)\cdot(y_{1_R}[n,k]^2+y_{1_I}[n,k]^2), \text{ and}$$

$$P_{y_2}[n,k]=\alpha\cdot P_{y_2}[n,k]+(1-\alpha)\cdot(y_{2_R}[n,k]^2+y_{2_I}[n,k]^2),$$

where: (a) $P_{y_1}[n, k]$ is AR smoothed power of $y_1[n, k]$ in the kth band; (b) $P_{y_2}[n, k]$ is AR smoothed power of $y_2[n, k]$ in the kth band; (c) $y_{1_R}[n, k]$ and $y_{1_I}[n, k]$ are real and imaginary parts of $y_1[n, k]$; and (d) $y_{2_R}[n, k]$ and $y_{2_I}[n, k]$ are real and imaginary parts of $y_2[n, k]$. In one example, $\alpha$=0.95.

The DSP 210 computes its estimate of a priori SNR as:

$$\text{a priori SNR}=P_s[n-1,k]/P_{y_2}[n-1,k],$$

where: (a) $P_s[n-1, k]$ is estimated power of clean speech for the immediately preceding time frame n−1; and (b) $P_{y_2}[n-1, k]$ is AR smoothed power of $y_2[n-1, k]$ in the kth band for the immediately preceding time frame n−1.

However, if $P_{y_2}[n-1, k]$ is unavailable (e.g., if the secondary voltage signal $V_2$ is unavailable), then the DSP 210 computes its estimate of a priori SNR as:

$$\text{a priori SNR}=P_s[n-1,k]/P_N[n-1,k],$$

where: (a) $P_N[n-1, k]$ is an estimate of noise level within $y_1[n-1, k]$; and (b) the DSP 210 estimates $P_N[n-1, k]$ in the same manner as discussed hereinbelow in connection with FIG. 8.

The DSP 210 computes $P_s[n-1, k]$ as:

$$P_s[n-1,k]=G[n-1,k]^2\cdot P_{y_1}[n-1,k],$$

where: (a) G[n−1, k] is the kth band's respective noise suppression gain for the immediately preceding time frame n−1; and (b) $P_{y1}$ [n−1, k] is AR smoothed power of $y_1[n-1, k]$ in the kth band for the immediately preceding time frame n−1.

The DSP 210 computes a posteriori SNR as:

$$\text{a posteriori SNR}=P_{y_1}[n,k]/P_{y_2}[n,k].$$

However, if $P_{y_2}[n, k]$ is unavailable (e.g., if the secondary voltage signal $V_2$ is unavailable), then the DSP 210 computes a posteriori SNR as:

$$\text{a posteriori SNR}=P_{y_1}[n,k]/P_N[n,k],$$

where: (a) $P_N[n, k]$ is an estimate of noise level within $y_1[n, k]$; and (b) the DSP 210 estimates $P_N[n, k]$ in the same manner as discussed hereinbelow in connection with FIG. 8.

In FIG. 7, various spectral subtraction curves show how G[n, k] ("attenuation") varies in response to both a posteriori SNR and estimated a priori SNR. One of those curves ("unshifted curve") is a baseline curve of a relationship between a posteriori SNR and G[n, k]. But the DSP 210 shifts the baseline curve horizontally (either left or right by a variable amount X) in response to estimated a priori SNR, as shown by the remaining curves of FIG. 7. A relationship between curve shift X and estimated a priori SNR was experimentally determined as X=estimated a priori SNR−15 dB.

For example, if estimated a priori SNR is relatively high, then Xis positive, so that the DSP 210 shifts the baseline curve left (which effectively increases G[n, k]), because the positive X indicates that $y_1[n, k]$ likely represents a smaller percentage of noise. Conversely, if estimated a priori SNR is relatively low, then X is negative, so that the DSP 210 shifts the baseline curve right (which effectively reduces G[n, k]), because the negative X indicates that $y_1[n, k]$ likely represents a larger percentage of noise. In this manner, the DSP 210 smooths G[n, k] transition and thereby reduces its rate of change, so that the DSP 210 reduces an extent of annoying musical noise artifacts (but without producing excessive smoothing distortion, such as reverberation), while nevertheless updating G[n, k] with sufficient frequency to handle relatively fast changes in the signals $V_1$ and $V_2$. To further achieve those objectives in various embodiments, the DSP 210 shifts the baseline curve horizontally (either left or right by a first variable amount) and/or vertically (either up or down by a second variable amount) in response to estimated a priori SNR, so that the baseline curve shifts in one dimension (e.g., either horizontally or vertically) or multiple dimensions (e.g., both horizontally and vertically).

In one example of the illustrative embodiments, the DSP 210 implements the curve shift X by precomputing an attenuation table of G[n, k] values (in response to various combinations of a posteriori SNR and estimated a priori SNR) for storage on the computer-readable medium 218, so that the DSP 210 determines G[n, k] in real-time operation by reading G[n, k] from such attenuation table in response to a posteriori SNR and estimated a priori SNR. In one version of the illustrative embodiments, the DSP 210 implements the curve shift X by computing G[n, k] as:

$$G[n,k]=\sqrt{(1-(10^{0.1\cdot CurveSNR})^{0.01}},$$

where CurveSNR=X·a posteriori SNR.

However, the DSP 210 imposes a floor on G[n, k] to ensure that G[n, k] is always greater than or equal to a value of the floor, which is programmable as a runtime parameter. In that manner, the DSP 210 further reduces an extent of annoying musical noise artifacts. In the example of FIG. 7, such floor value is −20 dB.

Figure 8:
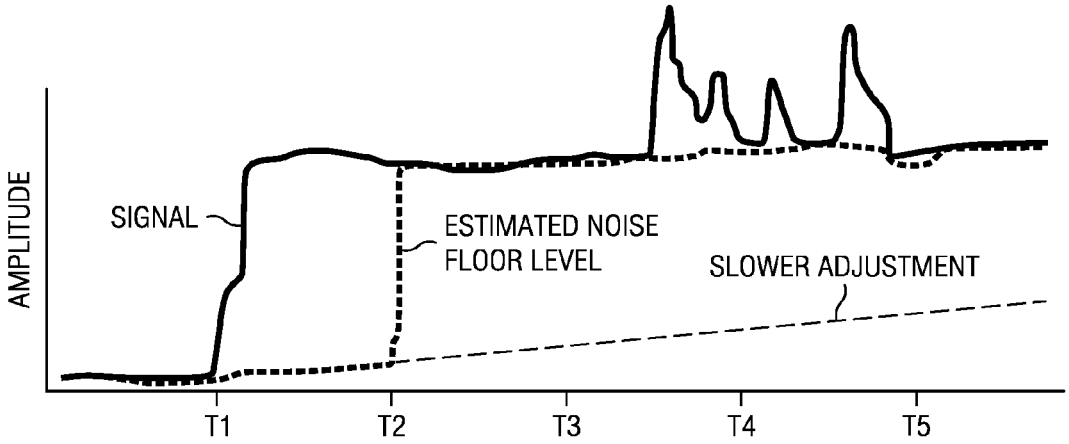
FIG. 8 is a graph that shows example levels of a signal and an estimated noise floor, as they vary over time.

FIG. 8 is a graph that shows example levels of $P_{x_1}[n]$ and $P_N[n]$, as they vary over time, where: (a) $P_{x_1}[n]$ is a power of $x_1[n]$; (b) $P_{x_1}[n]$ is denoted as "signal" in FIG. 8; and (c) $P_N[n]$ is denoted as "estimated noise floor level" in FIG. 8. In the example of FIG. 8, the DSP 210 estimates $P_N[n]$ in response to $P_{x_1}[n]$ for the BSS operation of FIGS. 3 and 4. In another example, if $P_{y_2}[n, k]$ is unavailable (e.g., if the secondary voltage signal $V_2$ is unavailable), then the DSP 210 estimates $P_N[n]$ in response to $P_{y_1}[n]$ (instead of $P_{x_1}[n]$) for the post processing operation of FIGS. 3 and 5, as discussed hereinabove in connection with FIG. 7.

In response to $P_{x_1}[n]$ exceeding $P_N[n]$ by more than a specified amount ("GAP") for more than a specified continuous duration, the DSP 210: (a) determines that such excess is more likely representative of noise level increase instead of speech; and (b) accelerates its adjustment of $P_N[n]$. In the illustrative embodiments, the DSP 210 measures the specified continuous duration as a specified number ("MAX") of consecutive time frames, which aggregately equate to at least such duration (e.g., 0.8 seconds).

In response to $P_{x_1}[n]$ exceeding $P_N[n]$ by less than GAP and/or for less than MAX consecutive time frames (e.g., between a time T3 and a time T5 in the example of FIG. 8), the DSP 210 determines that such excess is more likely representative of speech instead of additional noise. For example, if $P_{x_1}[n] \leq P_N[n] \cdot GAP$, then Count[n]=0, and the DSP 210 clears an initialization flag. In response to the initialization flag being cleared, the DSP 210 estimates $P_N[n]$ according to the time constants $C_u$ and $C_d$ (discussed hereinabove in connection with FIG. 4), so that $P_N[n]$ falls more quickly than it rises.

Conversely, if $P_{x_1}[n] > P_N[n] \cdot GAP$, then Count[n]=Count[n−1]+1. If Count[n]>MAX, then the DSP 210 sets the initialization flag. In response to the initialization flag being set, the DSP 210 estimates $P_N[n]$ with a faster time constant (e.g., in the same manner as the DSP 210 estimates $P_s[n]$ discussed hereinabove in connection with FIG. 4), so that $P_N[n]$ rises approximately as quickly as it falls. In an alternative embodiment, instead of determining whether $P_{x_1}[n] \leq P_N[n] \cdot GAP$, the DSP 210 determines whether $P_{x_1}[n] \leq P_N[n] + GAP$, so that: (a), if $P_{x_1}[n] \leq P_N[n] + GAP$, then Count[n]=0, and the DSP 210 clears the initialization flag; and (b) if $P_{x_1}[n] > P_N[n] + GAP$, then Count[n]=Count[n−1]+1.

In the example of FIG. 8: (a) $P_{x_1}[n]$ quickly rises at a time T1; (b) shortly after T1, $P_{x_1}[n]$ exceeds $P_N[n]$ by more than GAP; (c) at a time T2, more than MAX consecutive time frames have elapsed since T1; and (d) in response to $P_{x_1}[n]$ exceeding $P_N[n]$ by more than GAP for more than MAX consecutive time frames, the DSP 210 sets the initialization flag and estimates $P_N[n]$ with the faster time constant. By comparison, if the DSP 210 always estimated $P_N[n]$ according to the time constants $C_u$ and $C_d$, then the DSP 210 would have adjusted $P_N[n]$ with less precision and less speed (e.g., as shown by the "slower adjustment" line of FIG. 8). Also, in one embodiment, while initially adjusting $P_N[n]$ during its first 0.5 seconds of operation, the DSP 210 sets the initialization flag and estimates $P_N[n]$ with the faster time constant.

In the illustrative embodiments, a computer program product is an article of manufacture that has: (a) a computer-readable medium; and (b) a computer-readable program that is stored on such medium. Such program is processable by an instruction execution apparatus (e.g., system or device) for causing the apparatus to perform various operations discussed hereinabove (e.g., discussed in connection with a block diagram). For example, in response to processing (e.g., executing) such program's instructions, the apparatus (e.g., programmable information handling system) performs various operations discussed hereinabove. Accordingly, such operations are computer-implemented.

Such program (e.g., software, firmware, and/or microcode) is written in one or more programming languages, such as: an object-oriented programming language (e.g., C++); a procedural programming language (e.g., C); and/or any suitable combination thereof. In a first example, the computer-readable medium is a computer-readable storage medium. In a second example, the computer-readable medium is a computer-readable signal medium.

A computer-readable storage medium includes any system, device and/or other non-transitory tangible apparatus (e.g., electronic, magnetic, optical, electromagnetic, infrared, semiconductor, and/or any suitable combination thereof) that is suitable for storing a program, so that such program is processable by an instruction execution apparatus for causing the apparatus to perform various operations discussed hereinabove. Examples of a computer-readable storage medium include, but are not limited to: an electrical connection having one or more wires; a portable computer diskette; a hard disk; a random access memory ("RAM"); a read-only memory ("ROM"); an erasable programmable read-only memory ("EPROM" or flash memory); an optical fiber; a portable compact disc read-only memory ("CD-ROM"); an optical storage device; a magnetic storage device; and/or any suitable combination thereof.

A computer-readable signal medium includes any computer-readable medium (other than a computer-readable storage medium) that is suitable for communicating (e.g., propagating or transmitting) a program, so that such program is processable by an instruction execution apparatus for causing the apparatus to perform various operations discussed hereinabove. In one example, a computer-readable signal medium includes a data signal having computer-readable program code embodied therein (e.g., in baseband or as part of a carrier wave), which is communicated (e.g., electronically, electromagnetically, and/or optically) via wireline, wireless, optical fiber cable, and/or any suitable combination thereof.

Although illustrative embodiments have been shown and described by way of example, a wide range of alternative embodiments is possible within the scope of the foregoing disclosure.

What is claimed is:

1. A method performed by electronic circuitry for estimating a level of noise in a signal, the method comprising:

in response to the signal failing to exceed the estimated level of noise by more than a predetermined amount for more than a predetermined continuous duration, adjusting the estimated level of noise according to a first time constant in response to the signal rising and a second time constant in response to the signal falling, so that the estimated level of noise falls more quickly than it rises; and in response to the signal exceeding the estimated level of noise by more than the predetermined amount for more than the predetermined continuous duration, accelerating a speed of adjusting the estimated level of noise;

wherein adjusting the estimated level of noise includes: clearing a flag in response to the signal failing to exceed the estimated level of noise by more than the predetermined amount for more than the predetermined continuous duration; and, in response to the flag being cleared, adjusting the estimated level of noise according to the first time constant in response to the signal rising and the second time constant in response to the signal falling.

2. The method of claim 1, wherein accelerating the speed of adjusting the estimated level of noise includes: setting the flag in response to the signal exceeding the estimated level of noise by more than the predetermined amount for more than the predetermined continuous duration; and, in response to setting the flag, accelerating the speed of adjusting the estimated level of noise.

3. The method of claim 1, wherein accelerating the speed of adjusting the estimated level of noise includes: accelerating the speed of adjusting the estimated level of noise, so that the estimated level of noise rises approximately as quickly as it falls.

4. The method of claim 1, and comprising:

in response to the signal failing to exceed the estimated level of noise by more than the predetermined amount for more than the predetermined continuous duration, determining that a difference between the signal and the estimated level of noise is more likely representative of speech instead of noise.

5. The method of claim 4, and comprising:

in response to the signal exceeding the estimated level of noise by more than the predetermined amount for more than the predetermined continuous duration, determining that the difference between the signal and the estimated level of noise is more likely representative of an increased level of noise instead of speech.

6. The method of claim 1, wherein the signal exceeds the estimated level of noise by more than the predetermined amount if the signal is greater than a product of the estimated level of noise multiplied by the predetermined amount.

7. The method of claim 1, wherein the signal exceeds the estimated level of noise by more than the predetermined amount if the signal is greater than a sum of the estimated level of noise plus the predetermined amount.

8. The method of claim 1, and comprising: measuring the predetermined continuous duration as a predetermined number of consecutive time frames, which aggregately equate to at least the predetermined continuous duration.

9. The method of claim 1, wherein the predetermined amount is a specified amount, and the predetermined continuous duration is a specified continuous duration.

10. A system for estimating a level of noise, the system comprising:

electronic circuitry for: in response to the signal failing to exceed the estimated level of noise by more than a predetermined amount for more than a predetermined continuous duration, adjusting the estimated level of noise according to a first time constant in response to the signal rising and a second time constant in response to the signal falling, so that the estimated level of noise falls more quickly than it rises; and, in response to the signal exceeding the estimated level of noise by more than the predetermined amount for more than the predetermined continuous duration, accelerating a speed of adjusting the estimated level of noise;

wherein adjusting the estimated level of noise includes: clearing a flag in response to the signal failing to exceed the estimated level of noise by more than the predetermined amount for more than the predetermined continuous duration; and, in response to the flag being cleared, adjusting the estimated level of noise according to the first time constant in response to the signal rising and the second time constant in response to the signal falling.

11. The system of claim 10, wherein accelerating the speed of adjusting the estimated level of noise includes: setting the flag in response to the signal exceeding the estimated level of noise by more than the predetermined amount for more than the predetermined continuous duration; and, in response to setting the flag, accelerating the speed of adjusting the estimated level of noise.

12. The system of claim 10, wherein accelerating the speed of adjusting the estimated level of noise includes: accelerating the speed of adjusting the estimated level of noise, so that the estimated level of noise rises approximately as quickly as it falls.

13. The system of claim 10, wherein the electronic circuitry is for: in response to the signal failing to exceed the estimated level of noise by more than the predetermined amount for more than the predetermined continuous duration, determining that a difference between the signal and the estimated level of noise is more likely representative of speech instead of noise.

14. The system of claim 13, wherein the electronic circuitry is for: in response to the signal exceeding the estimated level of noise by more than the predetermined amount for more than the predetermined continuous duration, determining that the difference between the signal and the estimated level of noise is more likely representative of an increased level of noise instead of speech.

15. The system of claim 10, wherein the signal exceeds the estimated level of noise by more than the predetermined amount if the signal is greater than a product of the estimated level of noise multiplied by the predetermined amount.

16. The system of claim 10, wherein the signal exceeds the estimated level of noise by more than the predetermined amount if the signal is greater than a sum of the estimated level of noise plus the predetermined amount.

17. The system of claim 10, wherein the electronic circuitry is for: measuring the predetermined continuous duration as a predetermined number of consecutive time frames, which aggregately equate to at least the predetermined continuous duration.

18. The system of claim 10, wherein the predetermined amount is a specified amount, and the predetermined continuous duration is a specified continuous duration.

19. A computer program product for estimating a level of noise, the computer program product comprising:

a non-transitory computer-readable storage medium; and a computer-readable program stored on the non-transitory computer-readable storage medium, wherein the computer-readable program is processable by an information handling system for causing the information handling system to perform operations including: in response to the signal failing to exceed the estimated level of noise by more than a predetermined amount for more than a predetermined continuous duration, adjusting the estimated level of noise according to a first time constant in response to the signal rising and a second time constant in response to the signal falling, so that the estimated level of noise falls more quickly than it rises; and, in response to the signal exceeding the estimated level of noise by more than the predetermined amount for more than the predetermined continuous duration, accelerating a speed of adjusting the estimated level of noise;

wherein adjusting the estimated level of noise includes: clearing a flag in response to the signal failing to exceed the estimated level of noise by more than the predetermined amount for more than the predetermined continuous duration; and, in response to the flag being cleared, adjusting the estimated level of noise according to the first time constant in response to the signal rising and the second time constant in response to the signal falling.

20. The computer program product of claim 19, wherein accelerating the speed of adjusting the estimated level of noise includes: setting the flag in response to the signal exceeding the estimated level of noise by more than the predetermined amount for more than the predetermined continuous duration; and, in response to setting the flag, accelerating the speed of adjusting the estimated level of noise.

21. The computer program product of claim 19, wherein accelerating the speed of adjusting the estimated level of noise includes: accelerating the speed of adjusting the estimated level of noise, so that the estimated level of noise rises approximately as quickly as it falls.

22. The computer program product of claim 19, wherein the operations include: in response to the signal failing to exceed the estimated level of noise by more than the predetermined amount for more than the predetermined continuous duration, determining that a difference between the signal and the estimated level of noise is more likely representative of speech instead of noise.

23. The computer program product of claim 22, wherein the operations include: in response to the signal exceeding the estimated level of noise by more than the predetermined amount for more than the predetermined continuous duration, determining that the difference between the signal and the estimated level of noise is more likely representative of an increased level of noise instead of speech.

24. The computer program product of claim 19, wherein the signal exceeds the estimated level of noise by more than the predetermined amount if the signal is greater than a product of the estimated level of noise multiplied by the predetermined amount.

25. The computer program product of claim 9, wherein the signal exceeds the estimated level of noise by more than the predetermined amount if the signal is greater than a sum of the estimated level of noise plus the predetermined amount.

26. The computer program product of claim 19, wherein the operations include: measuring the predetermined continuous duration as a predetermined number of consecutive time frames, which aggregately equate to at least the predetermined continuous duration.

27. The computer program product of claim 19, wherein the predetermined amount is a specified amount, and the predetermined continuous duration is a specified continuous duration.

* * * * *